US010946989B2

(12) United States Patent
Abbas et al.

(10) Patent No.: US 10,946,989 B2
(45) Date of Patent: Mar. 16, 2021

(54) METHOD OF AND APPARATUS FOR PACKAGING SNACK FOOD CHIPS

(71) Applicant: Frito-Lay Trading Company GmbH, Berne (CH)

(72) Inventors: Bob Abbas, Rugby (GB); Michael Brandt, Lahnau (DE); Jan Christopher Fuller, Lahnau (DE)

(73) Assignee: Frito-Lay Trading Company GmbH, Berne (CH)

( * ) Notice: Subject to any disclaimer, the term of this patent is extended or adjusted under 35 U.S.C. 154(b) by 207 days.

(21) Appl. No.: 16/323,652

(22) PCT Filed: Aug. 8, 2017

(86) PCT No.: PCT/EP2017/070101

§ 371 (c)(1),
(2) Date: Feb. 6, 2019

(87) PCT Pub. No.: WO2018/029208

PCT Pub. Date: Feb. 15, 2018

(65) Prior Publication Data

US 2020/0277092 A1 Sep. 3, 2020

(30) Foreign Application Priority Data

Aug. 11, 2016 (GB) ..... 1613813

(51) Int. Cl.
*B65B 5/06* (2006.01)
*B65B 7/16* (2006.01)
(Continued)

(52) U.S. Cl.
CPC ..... *B65B 5/064* (2013.01); *B65B 7/16* (2013.01); *B65B 35/32* (2013.01); *B65B 35/34* (2013.01);
(Continued)

(58) Field of Classification Search
CPC ..... B65B 5/064; B65B 5/101; B65B 5/108; B65B 35/32; B65B 35/34; B65B 37/04;
(Continued)

(56) References Cited

U.S. PATENT DOCUMENTS 708,218 A * 9/1902 French ..... B65B 19/34 53/249
2,256,215 A * 9/1941 Orth et al. ..... B65D 71/00 53/255
(Continued)

FOREIGN PATENT DOCUMENTS

CN 2925111 Y 7/2007
CN 102180273 9/2011
(Continued)

OTHER PUBLICATIONS

PCT Search Report and Written Opinion for PCT/EP2017/070101 filed Aug. 8, 2017 (13 pages).
(Continued)

*Primary Examiner* — Stephen F. Gerrity
(74) *Attorney, Agent, or Firm* — Barnes & Thornburg LLP; G. Peter Nichols

(57) ABSTRACT

A method of packaging snack food chips, the method comprising the steps of: (a) providing a plurality of snack food chips as a shingled assembly of the snack food chips; (b) enclosing the shingled assembly within an elongate packaging container; (c) vibrating the shingled assembly supported so as to cause the snack food chips sequentially to fall from a free output end into the elongate packaging container while progressively translationally separating a closed end and the free output end to form a shingled stack extending away from the closed end; and (d) during at least a part of step (c), rotating the elongate packaging container so that the closed end is lowered while decreasing an angle
(Continued)

of inclination such that the shingled stack is being progressively formed.

34 Claims, 2 Drawing Sheets

(51) Int. Cl.

| | |
|---|---|
| ***B65B 35/32*** | (2006.01) |
| ***B65B 35/34*** | (2006.01) |
| ***B65B 39/00*** | (2006.01) |
| ***B65B 39/12*** | (2006.01) |
| ***B65B 39/14*** | (2006.01) |
| ***B65B 43/46*** | (2006.01) |
| ***B65B 43/60*** | (2006.01) |
| ***B65B 57/06*** | (2006.01) |
| ***B65B 57/12*** | (2006.01) |

(52) U.S. Cl.
CPC ..... *B65B 39/007* (2013.01); *B65B 39/12* (2013.01); *B65B 39/14* (2013.01); *B65B 43/46* (2013.01); *B65B 43/60* (2013.01); *B65B 57/06* (2013.01); *B65B 57/12* (2013.01)

(58) Field of Classification Search
CPC ..... B65B 39/00; B65B 39/007; B65B 39/12; B65B 39/14; B65B 43/46; B65B 43/54; B65B 43/60
USPC ..... 53/542, 247, 248, 249, 255, 260
See application file for complete search history.

(56) References Cited

U.S. PATENT DOCUMENTS

| | | | | |
|---|---|---|---|---|
| 3,890,764 | A * | 6/1975 | Hartman | B65B 5/08 53/542 |
| 3,903,674 | A * | 9/1975 | Brush et al. | B65B 5/064 53/253 |
| 4,052,838 | A | 10/1977 | Hilton et al. | |
| 5,685,127 | A | 11/1997 | Finkowski | |
| 6,578,344 | B1 * | 6/2003 | Fluck | B65B 5/064 53/255 |
| 6,662,534 | B2 * | 12/2003 | Straub et al. | B65B 5/064 53/255 |
| 2002/0119223 | A1 | 8/2002 | Buisson et al. | |
| 2003/0041570 | A1 * | 3/2003 | Theriault | B65B 35/243 53/542 |
| 2013/0333332 | A1 | 12/2013 | Smith | |

FOREIGN PATENT DOCUMENTS

| | | | |
|---|---|---|---|
| DE | 202009016645 | | 5/2011 |
| EP | 0900749 | A1 | 3/1999 |
| GB | 2500788 | | 10/2013 |
| JP | 05124602 | A * | 5/1993 |
| WO | 2011069578 | A1 | 6/2011 |

OTHER PUBLICATIONS

Office Action and translation issued in Chinese Application No. 2017800630050 dated Jun. 22, 2020.

* cited by examiner

METHOD OF AND APPARATUS FOR PACKAGING SNACK FOOD CHIPS

CROSS-REFERENCE TO RELATED APPLICATIONS

This application is a US 371 Application from PCT/EP2017/070101 filed Aug. 8, 2017, which claims priority to GB Application 1613813.3 filed Aug. 11, 2016, the technical disclosures of which are hereby incorporated by reference in their entirety.

BACKGROUND

1. Field of the Invention

The present invention relates to a method of and apparatus for packaging a plurality of snack food chips. The present invention particularly relates to the packaging of a stack of three-dimensionally shaped snack food chips.

2. Description of the Related Art

The manufacture of snack food chips well known. A variety of different snack food chips is known having various shapes and configurations, and compositions.

It is known to manufacture three-dimensionally shaped snack food chips which are then shingled to form a shingled assembly which can then be packaged as a stack of three-dimensionally shaped snack food chips in a packaging container. Various techniques are known in the art to provide a shingled assembly of chips which are then inserted into a packaging container in the form of a tube. However, when the chips have a non-uniform geometry, for example it is required to package triangular chips into a triangular canister, it can be difficult to insert the chips without chip breakage. Insertion techniques requiring a pushing mechanism can tend to have low production efficiency and high product waste, both of topical seasoning and of snack chips, in the form of broken and/or spilled snack food chips. When the three-dimensionally shaped snack food chip is triangular in plan, for example substantially equilateral, as is known for tortilla chips, it is difficult to orient and align the triangular chips so that a shingled assembly is reliably achieved which can then be reliably packaged.

There is a need in the art to provide a method of and apparatus for handling three-dimensionally shaped snack food chips which can then be packaged as a stack of three-dimensionally shaped snack food chips in a packaging container that can provide high production efficiency and reduced product waste, both of seasoning and of snack chips, in the form of broken and/or spilled snack food chips. There is also a need in the art to provide such a method and apparatus which can implemented in a snack food chip manufacturing line in a cost-effective manner with regard to both capital costs and production costs.

The present invention aims at least partially to meet those needs.

SUMMARY

The present invention accordingly provides a method of packaging snack food chips, the method comprising the steps of:

a) providing a plurality of snack food chips as a shingled assembly of the snack food chips supported on an elongate support which extends along and beneath the shingled assembly;

b) enclosing the shingled assembly supported on the elongate support within an elongate packaging container having a closed end, a free output end of the elongate support being located towards the closed end;

c) vibrating the shingled assembly supported on the elongate support so as to cause the snack food chips sequentially to fall from the free output end into the elongate packaging container while progressively translationally separating the closed end and the free output end so as progressively to form a shingled stack in the elongate packaging container extending away from the closed end; and d) during at least a part of step (c), rotating simultaneously the elongate support and the elongate packaging container so that the closed end is lowered and an angle of inclination of the shingled stack to the vertical is decreased while at least a part of the shingled stack is being progressively formed.

The present invention further provides an apparatus for packaging snack food chips, the apparatus comprising an elongate support for supporting a shingled assembly of a plurality of snack food chips, a holder for holding an elongate packaging container; a vibration mechanism coupled to the elongate support for vibrating the shingled assembly supported on the elongate support; a translation mechanism coupled to at least one of the holder and the elongate support for progressively translationally separating the holder from the elongate support; a rotation mechanism for simultaneously rotating the elongate support and the holder so as to decrease an angle of inclination to the vertical of the elongate packaging container on the holder and of the elongate support; and a controller configured to provide that the rotation mechanism and the translation mechanism function for at least an overlapping period of time.

Preferred features of these aspects of the present invention are defined in the dependent claims.

The preferred embodiments of the present invention can provide a method and apparatus for packaging a stack of three-dimensionally shaped snack food chips into a container with reduced or minimal damage to the chips, and loss of seasoning which has been applied to the snack food chips.

The preferred embodiments of the present invention can further provide a low cost method and apparatus for packaging such a stack of three-dimensionally shaped snack food chips which has low production costs as well as low capital expenditure. The conveying and insertion apparatus may be retrofitted to an existing snack food chip packaging production line.

Although the invention has particular application to the manufacture of shaped tortilla chips, the method of the present invention may be used to produce a variety of different snack food chip compositions, as well and shapes. For example, the snack food chip may comprise any cereal-based composition, and may comprise any of, any mixture of, or all of, maize, wheat, barley, rice or any other grain-derived product, as well as any seasoning, either within the cereal-based composition and/or applied as a topical seasoning. Alternatively, the snack food chip may comprise any vegetable-based composition, for example based on potato, either alone or in admixture with any other vegetable, or any cereal as described above.

The snack food chips may be provided with other product design features to improve eating quality, for example particular flavourings or texturizing components. The snack food chips are packaged so as to be provided in a consumer acceptable retail format, for example a packaging tube or carton, typically hermetically sealed, which is compatible with a retail sales environment.

BRIEF DESCRIPTION OF THE DRAWINGS

Embodiments of the present invention will now be described by way of example only with reference to the accompanying drawing, in which.

DETAILED DESCRIPTION

Figure 1:
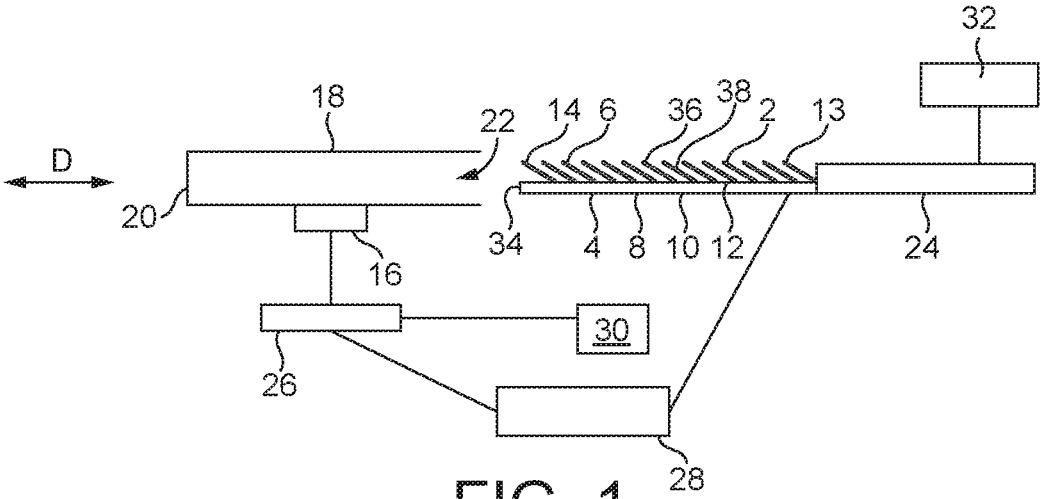
FIG. 1 schematically illustrates an apparatus for use in a method for packaging snack food chips in accordance with an embodiment of the present invention.

Referring to FIG. 1 of the accompanying drawings, there is schematically shown an apparatus for use in a method for packaging snack food chips 2, in particular tortilla chips, in accordance with an embodiment of the present invention. The apparatus and method of the illustrated embodiment are adapted to form a succession of packaged containers, each packaged with a respective stack of snack food chips, in a succession of packaging cycles.

The apparatus comprises an elongate support 4 for supporting a shingled assembly 6 of a plurality of the snack food chips 2. The elongate support 4 comprises a chute 8 comprising a bottom surface 10 and opposed side surfaces 12.

The snack food chips 2 are three-dimensionally shaped. In particular, the snack food chips 2 have a curvature about an axis of curvature which is generally aligned with a length of the shingled assembly 6. The snack food chips 2 may be regularly shaped, for example being triangular, square, rectangular, elliptical, etc., or be irregularly shaped. Typically, the snack food chips have a surface area of from 1000 to 2500 $mm^2$ and a maximum dimension of from 30 to 100 mm.

Figure 2:
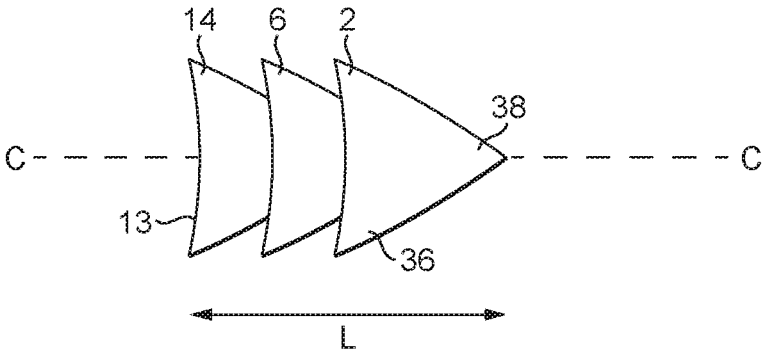
FIG. 2 schematically illustrates a plan view of three representative snack food chips shingled together as part of a shingled assembly to be packaged in accordance with the embodiment of FIG. 1.

In the preferred embodiment, as shown in FIG. 2, the snack food chips 2 are substantially triangular in plan, typically substantially equilaterally triangular in plan. Preferably, in the shingled assembly 6 one of the three triangular edges 13 of each of the substantially triangular snack food chips 2 is a foremost part 14 of each snack food chip 2, and typically is substantially orthogonal to a length L of the elongate shingled assembly 6. The axis of curvature C-C is generally aligned with the length L of the shingled assembly 6.

The snack food chips 2 may have any desired composition, and may include any cereal-based composition or vegetable-based composition suitable for making a snack food dough which may be subsequently cooked, for example by frying, baking, toasting, microwave cooking, or any other suitable cooking process, or any combination of cooking processes, to produce the desired taste and texture, for example a crispy texture, in the resultant chip. The dough may typically comprise a maize-based dough for the manufacture of snack food chips in the form of tortilla chips.

The snack food chips 2 packaged according to the present invention are three-dimensionally shaped snack food chips, and in particular may be shaped and dimensioned so as to be suitable for use together with a dip, such as a salsa composition, cream cheese, avocado composition, etc. which are well known in the snack food art.

The snack food chips 2 have typically been topically seasoned by application of a seasoning, which may be in powder and/or liquid form, which is deposited onto the snack food chips.

The apparatus also comprises a holder 16 for holding an elongate packaging container 18. The elongate packaging container 18 has a closed end 20 and an open end 22. The container 18 typically comprises a polymer or cardboard tube or canister, as is well known in the art. The container 18 may have a cross-sectional shape and dimensions which substantially match those of the plan of the snack food chips 2 to be packaged within the container 18.

A vibration mechanism 24 is coupled to the elongate support 4. The vibration mechanism 24 functions to vibrate the shingled assembly 6 supported on the elongate support 4.

A translation mechanism 26 is coupled to at least one of the holder 16 and the elongate support 4 for progressively translationally separating the holder 16 from the elongate support 4. In the illustrated embodiment, the translation mechanism 26 is coupled to the holder 16.

There is also provided a rotation mechanism 28 for simultaneously rotating the elongate support 4 and the holder 16. Such rotational motion functions to decrease an angle of inclination to the vertical of the elongate packaging container 18 on the holder 16 and of the elongate support 4.

A controller 30 is configured to provide a number of functional controls of the various components of the apparatus.

The controller 30 is configured to provide that the rotation mechanism 28 and the translation mechanism 26 function for at least an overlapping period of time. The controller 30 is configured to cause the translation mechanism 26 to move the holder 16 towards the elongate support 4.

The controller 30 is also configured to orient the elongate packaging container 18 on the holder 16 and the shingled assembly 6 supported on the elongate support 4 in a substantially horizontal orientation at the beginning of a packaging cycle, as shown in FIG. 1. The controller 30 is configured to align the holder 16 and the elongate support 4, in particular along a common direction D, and the rotation mechanism 28 is adapted to rotate the holder 16 and the elongate support 4 while the holder 16 and the elongate support 4 are aligned along the common direction D. The common direction D rotates with operation of the rotation mechanism 28.

The controller 30 is furthermore configured to control the vibration mechanism 24 so that vibration is carried out substantially continuously over an insertion period in a packaging cycle. The controller 30 is configured to control the vibration mechanism 24 so that vibration is initiated prior to initiation of the translation mechanism 26 in a packaging cycle and prior to initiation of the rotation mechanism 28 in a packaging cycle.

A retraction mechanism 32 is also provided for retracting the elongate support 4 away from the holder 16.

The method of packaging snack food chips in accordance with an embodiment of the present invention using the apparatus of FIG. 1 is now described, with additional reference to FIGS. 3A to 3E, which schematically illustrate a sequence of steps in the packaging cycle.

In the method, there is provided a plurality of the snack food chips 2 formed as a shingled assembly 6 of the snack food chips 2 supported on the elongate support 4 which extends along and beneath the shingled assembly 6. The shingled assembly 6 comprises a measured dose (e.g. by weight) of the snack food chips 2. In the shingled assembly 6 each snack food chip 2, apart from the rearmost snack food chip 2 which is furthest from a free output end 34 of the elongate support 4, has a rear part 36 which is overlapped by a front part 38 of the adjacent rearward snack food chip 2.

Figure 3A:
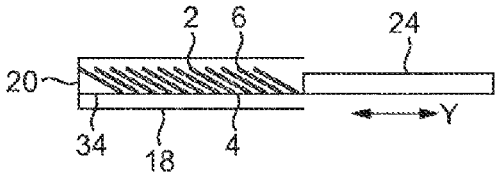
FIGS. 3A, 3B, 3C, 3D, and 3E schematically illustrate a sequence of steps in the packaging cycle of the method of packaging snack food chips in accordance with an embodiment of the present invention using the apparatus of FIG. 1.

As is shown in FIG. 3A, the elongate packaging container 18 and the shingled assembly 6 supported on the elongate support 4 are aligned. The shingled assembly 6 is then enclosed within the elongate packaging container 18 so that the free output end 34 of the elongate support 4 is located towards the closed end 20. The elongate packaging container 18 is pushed over the shingled assembly 6 supported on the elongate support 4. The elongate packaging container 18 and the shingled assembly 6 supported on the elongate support 4 are substantially horizontal.

Figure 3B:
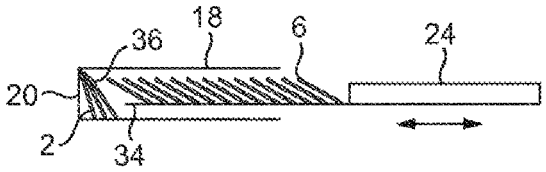

Then, as is shown in FIG. 3B, the vibration mechanism 24 vibrates the shingled assembly 6 so as to cause the snack food chips 2 sequentially to fall, under the action of gravity, from the free output end 34 into the elongate packaging container 18 while the translation mechanism 26 progressively translationally separates the closed end 20 and the free output end 34. These actions progressively form a shingled stack 36 in the elongate packaging container 18 extending away from the closed end 20. The snack food chips 2 are not pushed into the container 18, which otherwise may damage or break them, but instead they fall into the container 18 solely under the action of gravity as a result of being vibrated from the support.

Figure 3C:
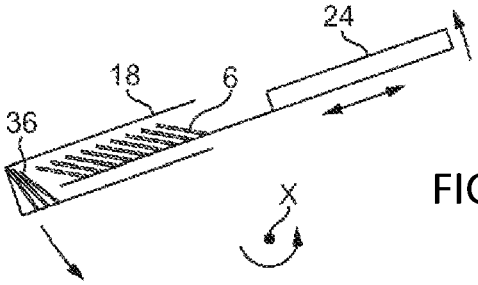

During the vibration and rotation steps, the elongate packaging container 18 and the shingled assembly 6 supported on the elongate support 4 are aligned along the common direction D, which rotates during the rotation step, by action of the rotation mechanism 28, as is shown in FIG. 3C.

During at least a part of the vibration step, the elongate support 4 and the elongate packaging container 18 are rotated simultaneously, about a substantially horizontal axis X, by operation of the rotation mechanism 28 so that the closed end 20 is lowered and an angle of inclination of the shingled stack 36 to the vertical is decreased while at least a part of the shingled stack 36 is being progressively formed. The rotation inclines the chute 8 and the container 18 so that the snack food chips 2 more easily straighten up and form a shingled stack 36 in the container 18 after they have sequentially fallen off the end 34 of the chute 8.

The vibration is carried out substantially continuously. The vibration is initiated prior to translationally separating the closed end 20 and the free output end 34 and prior to the rotational movement. The vibration is along an axis Y which is parallel or aligned with the elongate support 4. The vibration has an amplitude which is less than the spacing between adjacent snack food chips 2 in the shingled assembly 6.

The closed end 20 and the free output end 34 are translationally separated by moving the closed end 20 away from the free output end 34 by operation of the translation mechanism 26.

Figure 3D:
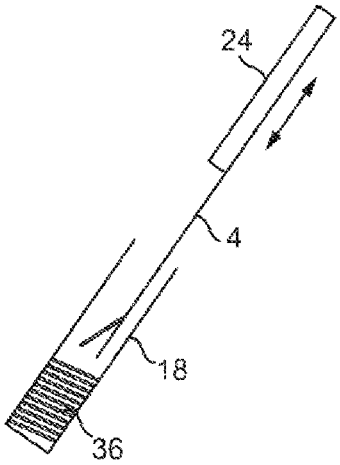

The shingled stack 36 is completed while the elongate packaging container 18 is inclined to the vertical as is shown in FIG. 3D, and while the elongate support 4 is at least partly within the elongate packaging container 18.

Figure 3E:
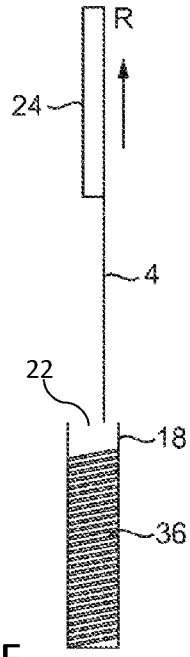

After the shingled assembly 6 on the elongate support 4 has been deposited into the elongate packaging container 18, as is shown in FIG. 3E, the elongate support 4 is retracted, by the retraction mechanism 32, in direction completely out of the elongate packaging container 18. Retraction of the chute 8 allows the snack food chips 2 to become more compressed in the shingled stack 36 in the container 18.

Thereafter, the elongate packaging container 18 is oriented in a vertical orientation. In a final step of the packaging cycle, a closure (not shown) is applied to the upper open end 22 of the elongate packaging container 18.

The preferred embodiments of the present invention provide a number of technical advantages and effects. The chips sequentially fall solely under the action of gravity to form a shingled stack in the container from the initial shingled assembly outside the container. This can readily maintain the alignment of the chips to facilitate subsequent shingling and stacking in the container. Chip breakage and seasoning loss can be minimised. The present invention is particularly effective at stacking and packaging three-dimensionally curved chips having a non-uniform shape, for example triangular chips, typically tortilla chips, which need to be aligned and stacked in a container having a triangular cross-section.

Various other modifications to the apparatus and method of the present invention will be readily apparent to those skilled in the art.

The invention claimed is:

1. A method of packaging snack food chips, the method comprising:

(a) providing a plurality of snack food chips as a shingled assembly of the snack food chips supported on an elongate support which extends along and beneath the shingled assembly, the elongate support having a free end;

(b) enclosing the shingled assembly supported on the elongate support within an elongate packaging container having a closed end by pushing the elongate packaging container over the shingled assembly supported on the elongate support, the free end of the elongate support being located towards the closed end of the elongate packaging container, wherein the elongate packaging container and the shingled assembly supported on the elongate support are substantially horizontal during the enclosing;

(c) vibrating the shingled assembly supported on the elongate support to cause the snack food chips to sequentially fall from the free end of the elongate support into the elongate packaging container while progressively translationally separating the closed end and the free end to progressively form a shingled stack in the elongate packaging container extending away from the closed end, wherein when vibrating commences, the elongate packaging container and the shingled assembly supported on the elongate support are substantially horizontal and wherein vibration is along an axis that is parallel or aligned with the elongate support; and (d) during the vibrating and while progressively translationally separating the closed end and the free end, rotating simultaneously the elongate support and the elongate packaging container so that the closed end is lowered and an angle of inclination of the shingled stack to the substantially horizontal position increases while at least a part of the shingled stack is being progressively formed.

2. A method according to claim 1 wherein in step (c) the snack food chips sequentially fall under the action of gravity from the free end into the elongate packaging container.

3. A method according to claim 1 wherein the elongate support comprises a chute comprising a bottom surface and opposed side surfaces.

4. A method according to claim 1 wherein in step (c) the vibration is carried out substantially continuously.

5. A method according to claim 1 wherein in step (c) the vibration is initiated prior to translationally separating the closed end and the free end and/or the vibration is initiated prior to the rotational movement of step (d).

6. A method according to claim 1 wherein in step (c) a direction of the vibration is along an axis which is parallel or aligned with the elongate support.

7. A method according to claim 1 wherein in step (c) the closed end and the free end are translationally separated by moving the closed end away from the free end.

8. A method according to claim 1 wherein the shingled assembly comprises a measured dose of the snack food chips.

9. A method according to claim 1 wherein the shingled stack is completed while the elongate packaging container is inclined.

10. A method according to claim 1 wherein the shingled stack is completed while the elongate support is at least partly within the elongate packaging container.

11. A method according to claim 1 further comprising a step (e) performed after step (d), of retracting the elongate support completely out of the elongate packaging container.

12. A method according to claim 11 further comprising a step (f) performed after step (e), of orienting the elongate packaging container to a position orthogonal to the horizontal position of step (c).

13. A method according to claim 11 further comprising, after at least step (e), a step (g) of applying a closure to an upper open end of the elongate packaging container.

14. A method according to claim 1 wherein in the shingled assembly each snack food chip, apart from the rearmost snack food chip which is furthest from the closed end, has a rear part which is overlapped by a front part of the adjacent rearward snack food chip.

15. A method according to claim 1 wherein in step (b) the elongate packaging container and the shingled assembly supported on the elongate support are aligned.

16. A method according to claim 1 wherein in step (c) the elongate packaging container and the shingled assembly supported on the elongate support are aligned.

17. A method according to claim 1 wherein in step (d) the elongate packaging container and the shingled assembly supported on the elongate support are aligned.

18. A method according to claim 1 wherein in step (b), (c) and (d) the elongate packaging container and the shingled assembly supported on the elongate support are aligned along a common direction.

19. A method according to claim 1 wherein the snack food chips are three-dimensionally shaped.

20. A method according to claim 19 wherein the snack food chips have a curvature about an axis of curvature which is generally aligned with a length of the shingled assembly.

21. A method according to claim 19 wherein the snack food chips are substantially triangular in plan.

22. A method according to claim 21 wherein the snack food chips are substantially equilaterally triangular in plan.

23. A method according to claim 21 wherein in the shingled assembly one of the three triangular edges of each of the substantially triangular snack food chips is a foremost part of each snack food chip.

24. A method according to claim 23 wherein in the shingled assembly the said one of the three triangular edges is substantially orthogonal to a length of the elongate shingled assembly.

25. An apparatus for packaging snack food chips, the apparatus comprising:

an elongate support for supporting a shingled assembly of a plurality of snack food chips in a substantially horizontal position, a holder for holding an elongate packaging container in the substantially horizontal position;

a vibration mechanism coupled to the elongate support for vibrating the shingled assembly supported on the elongate support;

a translation mechanism coupled to at least one of the holder and the elongate support for progressively translationally separating the holder from the elongate support;

a rotation mechanism for simultaneously rotating the elongate support and the holder so as to increase an angle of inclination from the substantially horizontal position of the elongate packaging container on the holder and of the elongate support; and a controller configured to provide that the rotation mechanism and the translation mechanism function for at least an overlapping period of time.

26. An apparatus according to claim 25 wherein the elongate support comprises a chute comprising a bottom surface and opposed side surfaces.

27. An apparatus according to claim 25 wherein the controller is configured to cause the translation mechanism to move the holder towards the elongate support.

28. An apparatus according to claim 25 wherein the controller is configured to orient the elongate packaging container on the holder and the shingled assembly supported on the elongate support in substantially horizontal position at a beginning of a packaging cycle.

29. An apparatus according to claim 25 wherein the controller is configured to control the vibration mechanism so that vibration is carried out substantially continuously over an insertion period that includes the formation of a shingled stack of the plurality of snack food chips in the elongate packaging container during a packaging cycle.

30. An apparatus according to claim 25 wherein the controller is configured to control the vibration mechanism so that vibration is initiated prior to initiation of the translation mechanism in a packaging cycle.

31. An apparatus according to claim 25 wherein the controller is configured to control the vibration mechanism so that vibration is initiated prior to initiation of the rotation mechanism in a packaging cycle.

32. An apparatus according to claim 25 further comprising a retraction mechanism for retracting the elongate support away from the holder.

33. An apparatus according to claim 25 wherein the controller is configured to align the holder and the elongate support.

34. An apparatus according to claim 33 wherein the controller is configured to align the holder and the elongate support along a common direction and the rotation mechanism is adapted to rotate the holder and the elongate support while the holder and the elongate support are aligned along the common direction.

* * * * *